US011653796B1

(12) United States Patent
McGlory

(10) Patent No.: US 11,653,796 B1
(45) Date of Patent: May 23, 2023

(54) SHOWER CHAIR ASSEMBLY

(71) Applicant: Hazel McGlory, Phoenix, AZ (US)

(72) Inventor: Hazel McGlory, Phoenix, AZ (US)

( * ) Notice: Subject to any disclaimer, the term of this patent is extended or adjusted under 35 U.S.C. 154(b) by 0 days.

(21) Appl. No.: 17/549,287

(22) Filed: Dec. 13, 2021

(51) Int. Cl.
*A47K 3/28* (2006.01)

(52) U.S. Cl.
CPC ..... *A47K 3/282* (2013.01)

(58) Field of Classification Search
CPC ..... A47K 3/282; A47K 1/04; A47K 3/122
USPC ..... 4/611, 483
See application file for complete search history.

(56) References Cited

U.S. PATENT DOCUMENTS 3,215,469 A * 11/1965 Wamsley ..... A61G 5/125 5/604
3,848,922 A * 11/1974 Blanford ..... A61G 5/12 297/219.1
5,459,887 A 10/1995 Roman
5,937,454 A 8/1999 Drew
6,279,178 B1 * 8/2001 Hill ..... A61G 5/1002 4/578.1
6,766,543 B1 7/2004 Hollis
7,328,953 B2 2/2008 Werschmidt
10,694,897 B2 6/2020 Hart
11,013,373 B1 * 5/2021 Lumpkin ..... A61H 33/601
2008/0265548 A1 * 10/2008 Hammer ..... A61G 5/0875 29/428
2020/0330297 A1 10/2020 Matters
2021/0145218 A1 * 5/2021 Shyka ..... A61H 33/6021

FOREIGN PATENT DOCUMENTS

WO 20191 19014 6/2019

* cited by examiner

*Primary Examiner* — Huyen D Le

(57) ABSTRACT

A shower chair assembly for facilitation of foot care includes a framework, which is selectively positionable in a shower enclosure. A seat is engaged to an upper end of the framework for seating of a user. A backrest is hingedly engaged to rear of the framework, proximate to the upper end, so that the backrest is selectively reclinable. The backrest supports a back of the user. A footrest is engaged to and extends from a front of the framework. The footrest is selectively positionable between the upper end and a lower end of the framework and is supports feet of the user to facilitate completion of hygienic and beautification tasks on the feet.

17 Claims, 5 Drawing Sheets

SHOWER CHAIR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to chair assemblies and more particularly pertains to a new chair assembly for facilitation of foot care. The present invention discloses a chair assembly for a shower enclosure which has a reclinable backrest and a selectively positionable footrest

(2) Description of Related Art Including Information Disclosed Under 37 CFR 1.97 and 1.98

The prior art relates to chair assemblies. Prior art chair assemblies include chair assemblies having positioning options for head supports, backrests, and leg supports for users in sitting or reclining positions. What is lacking in the prior art is a chair assembly for a shower enclosure which has a reclinable backrest in combination with a selectively positionable footrest.

BRIEF SUMMARY OF THE INVENTION

An embodiment of the disclosure meets the needs presented above by generally comprising a framework, which is configured to be selectively positioned in a shower enclosure. A seat is engaged to an upper end of the framework and is configured to seat a user. A backrest is hingedly engaged to rear of the framework, proximate to the upper end, so that the backrest is selectively reclinable. The backrest is configured to support a back of the user. A footrest is engaged to and extends from a front of the framework. The footrest is selectively positionable between the upper end and a lower end of the framework and is configured to support feet of the user to facilitate completion of hygienic and beautification tasks on the feet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
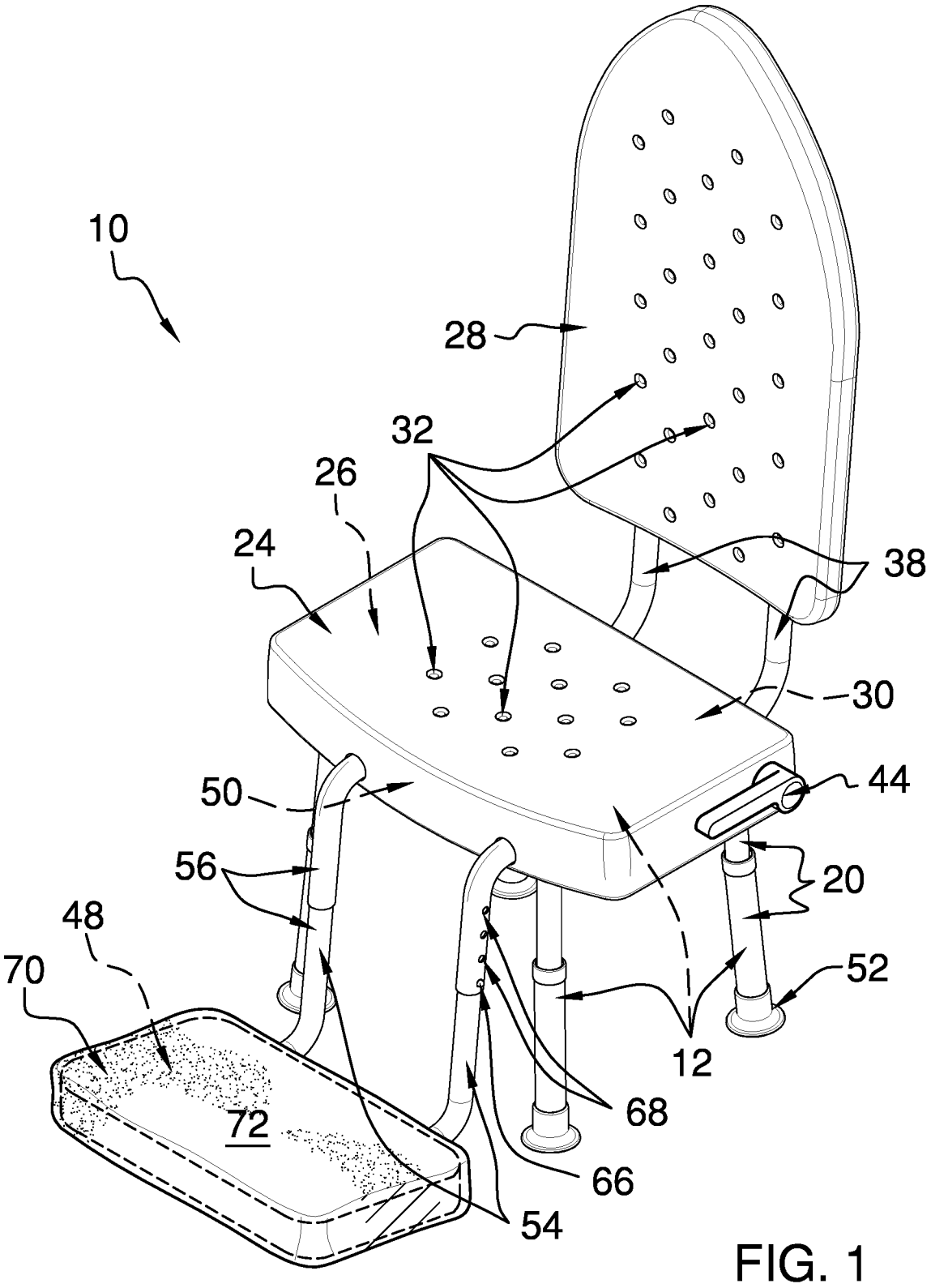
FIG. 1 is an isometric perspective view of a shower chair assembly according to an embodiment of the disclosure.
Figure 2:
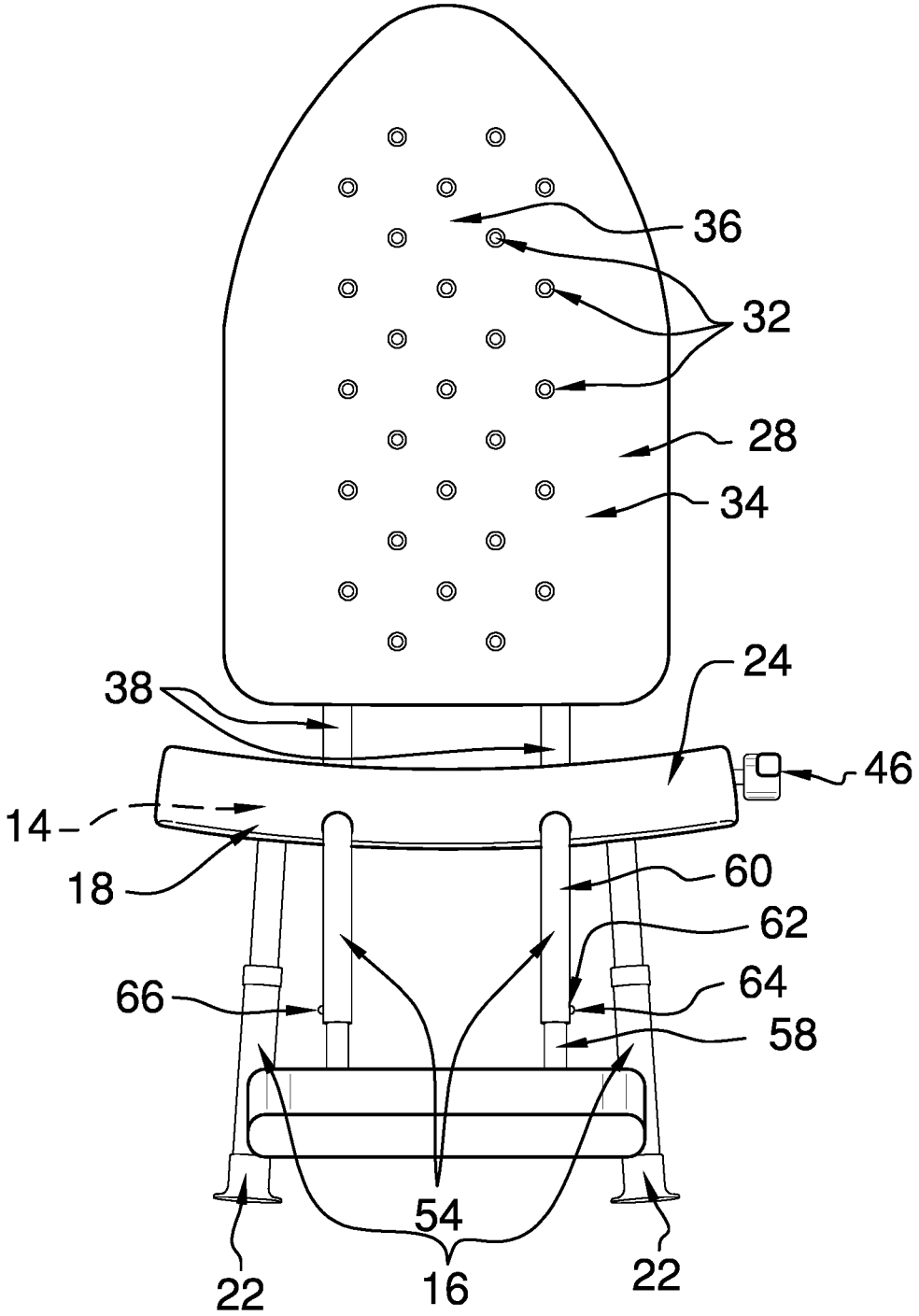
FIG. 2 is a front view of an embodiment of the disclosure.

With reference now to the drawings, and in particular to FIGS. 1 through 5 thereof, a new chair assembly embodying the principles and concepts of an embodiment of the disclosure and generally designated by the reference numeral 10 will be described.

As best illustrated in FIGS. 1 through 5, the shower chair assembly 10 generally comprises a framework 12, which is configured to be selectively positioned in a shower enclosure. The framework 12 comprises a frame 14 and a plurality of legs 16. The frame 14 is substantially rectangularly shaped. Each leg 16 is engaged to and extends from a respective corner 18 of the frame 14. Each leg 16 may comprise a pair of nestable sections 20 so that the leg 16 is selectively extensible.

Each of a plurality of feet 22 is engaged to a respective leg 16 distal from the frame 14. The feet 22 comprise rubber, silicone, or elastomer and thus are resiliently compressible so that the feet 22 are configured to frictionally engage a surface of the shower enclosure upon with the framework 12 is positioned. The feet 22 may be cup-shaped and thus configured to suctionally engage the surface.

A seat 24 is engaged to an upper end 26 of the framework 12 and is configured to seat a user. A backrest 28 is hingedly engaged to rear 30 of the framework 12, proximate to the upper end 26, so that the backrest 28 is selectively reclinable. The backrest 28 is configured to support a back of the user. The backrest 28 and the seat 24 may be molded so that the backrest 28 and the seat 24 are convex and thus configured to complement contours of buttocks and the back of the user. A plurality of apertures 32 is positioned in the seat 24 and the backrest 28 and is configured to drain water from the seat 24 and the backrest 28.

The backrest 28 comprises a first section 34 and a second section 36. The first section 34 is positioned proximate to the seat 24 and is substantially rectangularly shaped. The first section 34 is configured to support the back of the user. The second section 36 extends arcuately from and substantially coplanarly with the first section 34 distal from the seat 24. The second section 36 is configured to support a head and a neck of the user.

A pair of bars 38 is hingedly engaged to the framework 12. The backrest 28 is engaged to the pair of bars 38. Each bar 38 comprises a first segment 40 and a second segment 42. The first segment 40 is arcuate and is positioned proximate to the framework 12. The second segment 42 extends linearly from the first segment 40.

An actuator 44 is engaged to the framework 12 and is operationally engaged to the backrest 28. The actuator 44 is configured to be selectively actuated to hinge the backrest 28 relative to the framework 12. The actuator 44 may comprise a lever 46, or other actuating means, such as, but not limited to, depressible buttons, slide locks, and the like.

Figure 5:
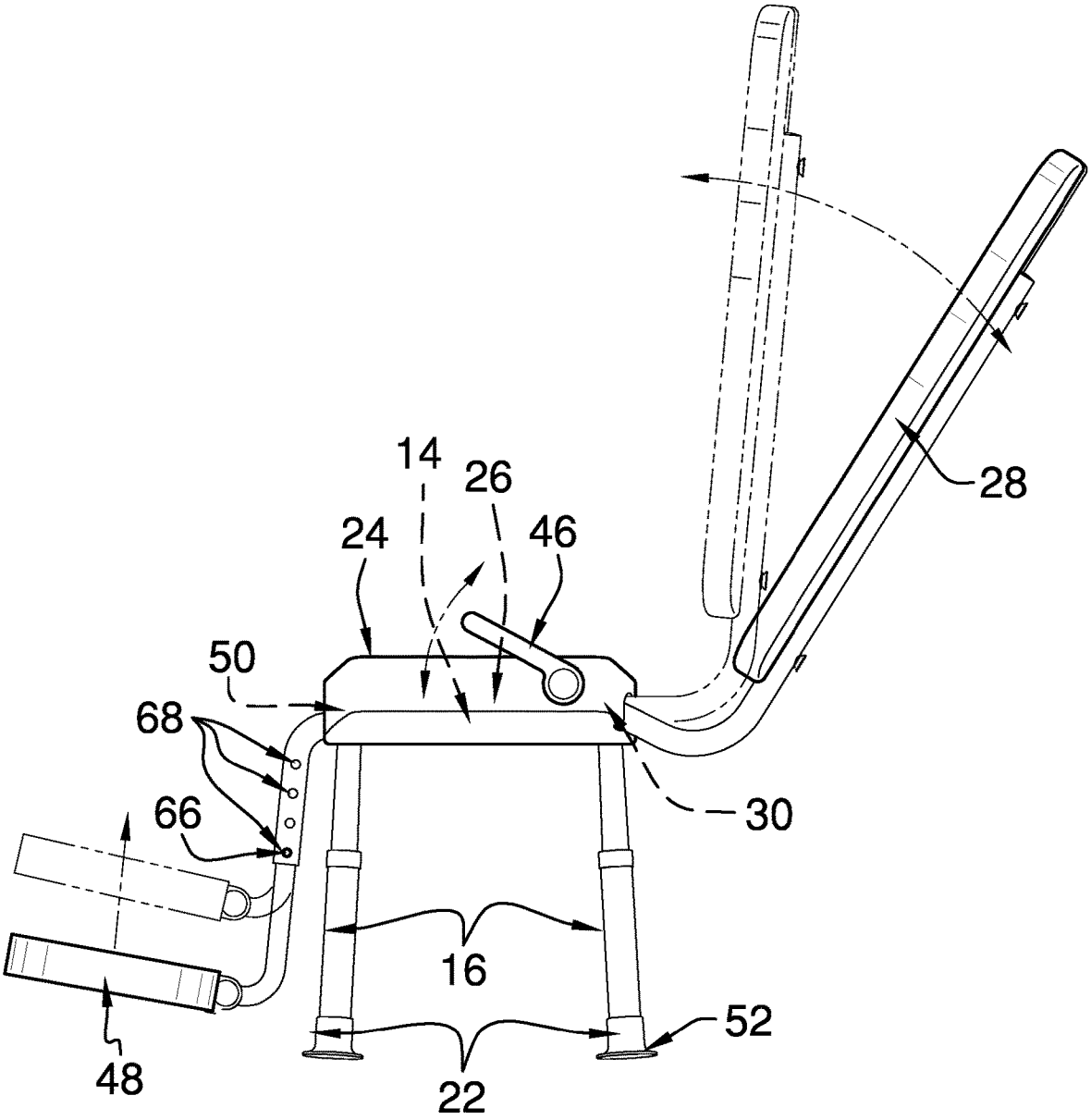
FIG. 5 is an in-use view of an embodiment of the disclosure.

A footrest 48 is engaged to and extends from a front 50 of the framework 12. The footrest 48 is selectively positionable between the upper end 26 and a lower end 52 of the framework 12, as shown in FIG. 5. The footrest 48 is configured to support feet of the user to facilitate completion of hygienic and beautification tasks on the feet.

Figure 4:
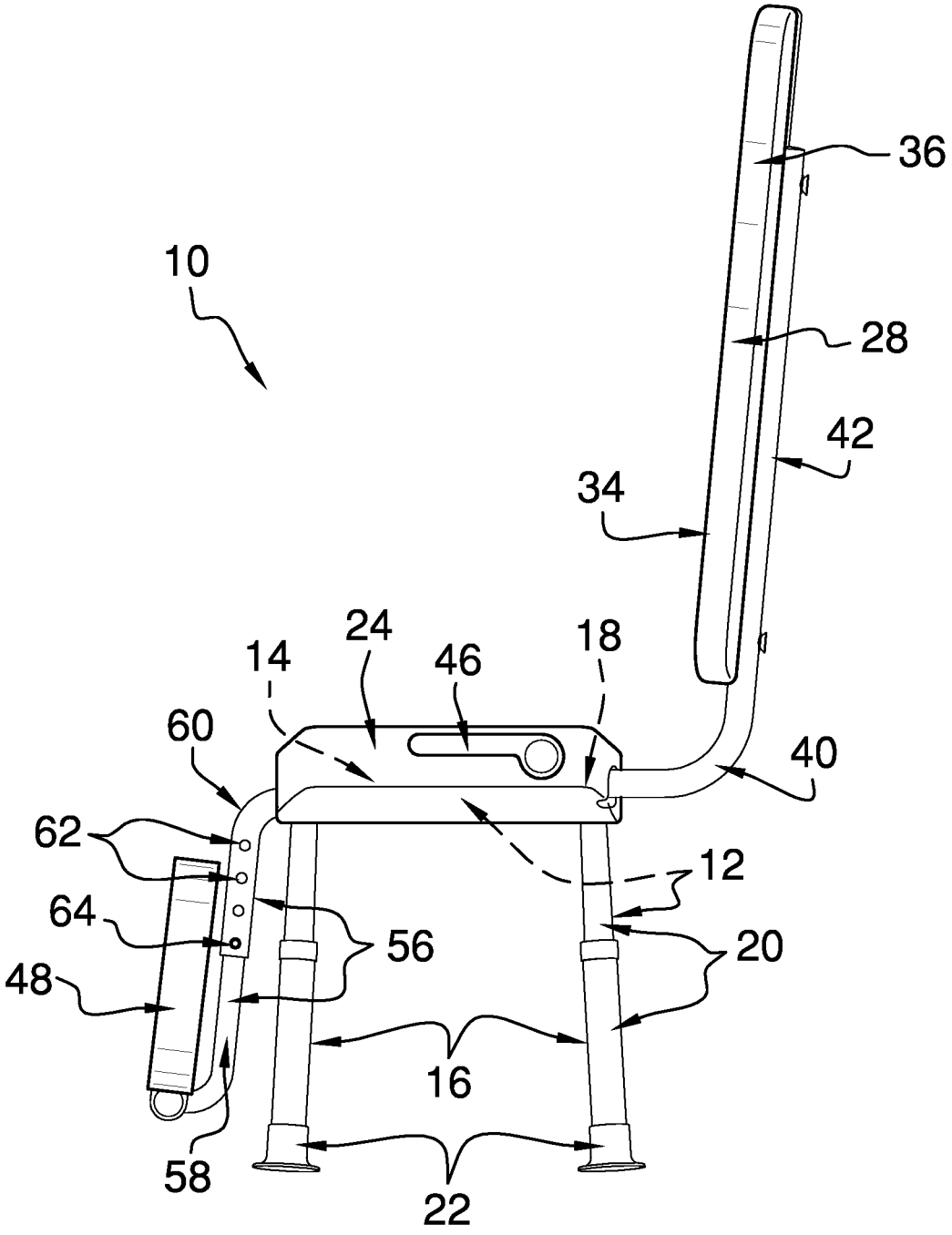
FIG. 4 is a side view of an embodiment of the disclosure.

A pair of rods 54 is engaged to the upper end 26 of the framework 12 and extends transversely to the front 50 of the framework 12 toward the lower end 52 of the framework 12. The footrest 48 is engaged to the pair of rods 54 distal from the framework 12. Each rod 54 comprises a plurality of nested segments 56 so that the rod 54 is selectively extensible to adjust the footrest 48 relative to the seat 24. The footrest 48 may be hingedly engaged to the pair of rods 54. The footrest 48 is configured to be selectively hinged between a deployed configuration, as shown in FIG. 5, and a stowed configuration, as shown in FIG. 4.

The plurality of nested segments 56 may comprise a lower segment 58, which is selectively extensible from an upper segment 60. The present invention also anticipates the plurality of nested segments 56 comprising more than two nested segments 56 and the upper segment 60 being extensible from the lower segment 58.

Each of a pair of first fasteners 62 is engaged to a respective upper segment 60. Each of a pair of second fasteners 64 is engaged to a respective lower segment 58. The second fastener 64 is complementary to the first fasteners 62 so that the second fastener 64 is positioned to selectively engage an associated first fastener 62 to fixedly position the respective lower segment 58 relative to an associated upper segment 60. The second fastener 64 may comprise a pin 66, which is spring-loaded. The associated first fastener 62 may comprise a plurality of holes 68. The present invention anticipates other fastening means for fixedly positioning the respective lower segment 58 relative to the associated upper segment 60, such as, but not limited to, flip lock clamps, twist lock rings, and the like.

Figure 3:
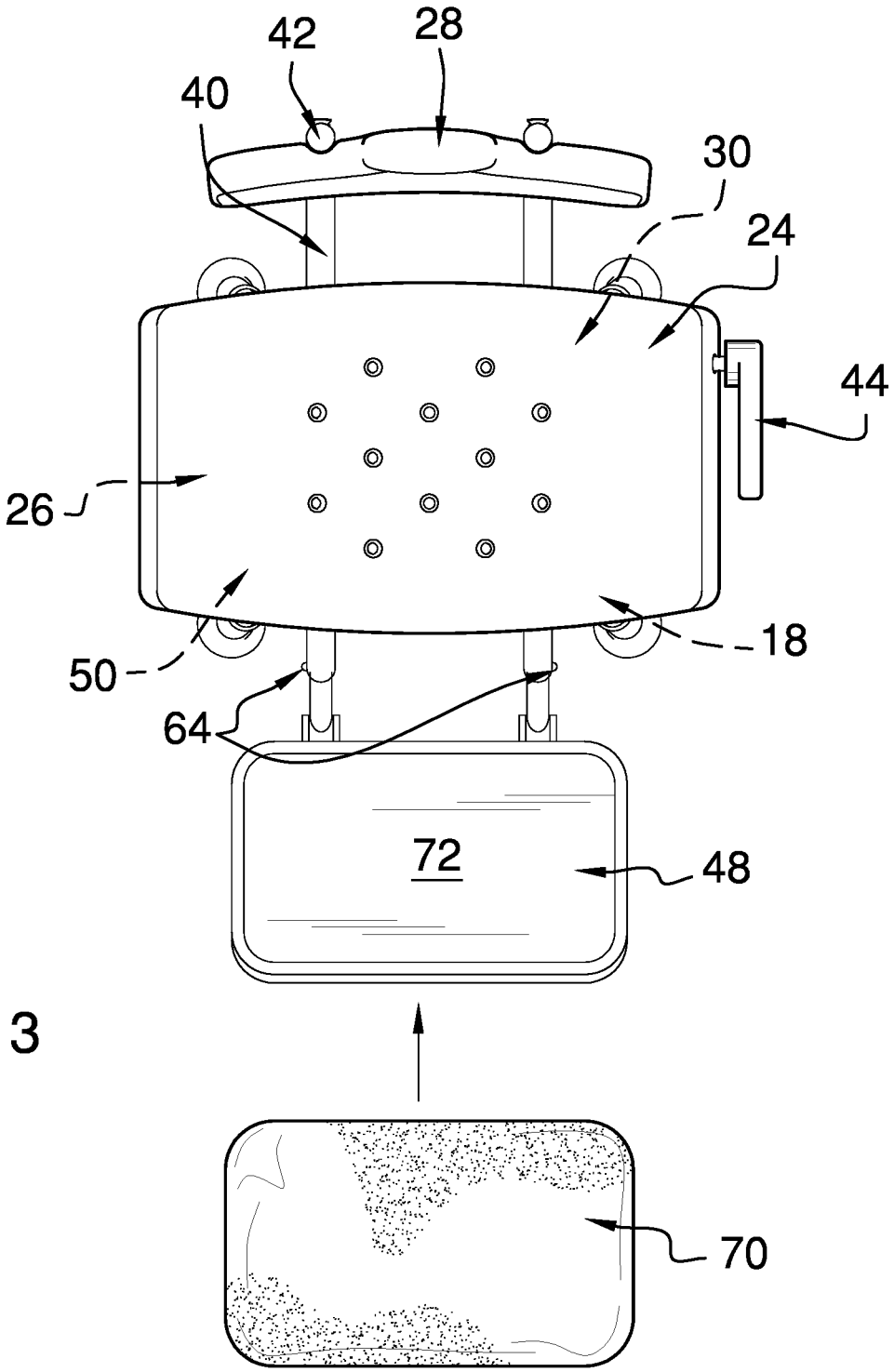
FIG. 3 is a top view of an embodiment of the disclosure.

The shower chair assembly 10 also may comprise a cover 70, as shown in FIG. 3. The cover 70 is selectively engageable to the footrest 48 to removably cover at least an upper face 72 of the footrest 48. The cover 70 is configured for positioning of the feet of the user and to be removed for laundering.

In use, the shower chair assembly 10 is positioned in a shower enclosure. The footrest 48 is adjusted to a comfortable position for the user, who then sits on the seat 24. The user then is positioned to perform hygienic and beautification tasks on their feet. If the hygienic and beautification tasks are to be performed by another person, the user can use the lever 46 to recline the backrest 28 to a comfortable position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shower chair assembly comprising:

a framework configured for selectively positioning in a shower enclosure, the framework including a frame and a plurality of legs, each leg being engaged to and extending from the frame;

a plurality of feet, each foot being engaged to a respective leg distal from the frame, each foot having a planar bottom edge;

a seat engaged to an upper end of the framework, wherein the seat is configured for seating a user;

a backrest hingedly engaged to rear of the framework proximate to the upper end, such that the backrest is selectively reclinable, wherein the backrest is configured for supporting a back of the user;

wherein the backrest and the seat are molded, such that the backrest and the seat are convex, wherein the backrest and the seat are configured for complementing contours of buttocks and the back of the user;

a single footrest engaged to and extending from a front of the framework and being selectively positionable between the upper end and a lower end of the framework, wherein the footrest is configured for supporting feet of the user, for facilitating completion of hygienic and beautification tasks on the feet, said footrest being centered relative to a pair of lateral sides of said framework and projecting forwardly relative to said seat wherein said footrest is configured for supporting both feet of the user simultaneously; and a cover selectively engageable to the footrest for removably covering at least an upper face of the footrest, wherein the cover is configured for positioning of the feet of the user and for being removed for laundering.

2. The shower chair assembly of claim 1, wherein the frame is substantially rectangularly shaped; and each leg extends from a respective corner of the frame.

3. The shower chair assembly of claim 1, wherein each leg comprising a pair of nestable sections, such that the leg is selectively extensible.

4. The shower chair assembly of claim 1, further including the feet being resiliently compressible, such that the feet are configured for frictionally engaging a surface of the shower enclosure upon with the framework is positioned.

5. The shower chair assembly of claim 4, wherein the feet comprise rubber, silicone, or elastomer.

6. The shower chair assembly of claim 1, wherein the feet are cup-shaped, wherein the feet are configured for suctionally engaging the surface.

7. The shower chair assembly of claim 1, wherein the backrest comprises:

a first section positioned proximate to the seat, the first section being substantially rectangularly shaped, wherein the first section is configured for supporting the back of the user; and a second section extending arcuately from and substantially coplanarly with the first section distal from the seat, wherein the second section is configured for supporting a head and a neck of the user.

8. The shower chair assembly of claim 1, further including a pair of bars hingedly engaged to the framework, the backrest being engaged to the pair of bars.

9. The shower chair assembly of claim 8, wherein each bar comprises a first segment and a second segment, the first segment being arcuate and proximate to the framework, the second segment extending linearly from the first segment.

10. The shower chair assembly of claim 1, further including an actuator engaged to the framework and being operationally engaged to the backrest, wherein the actuator is configured for being selectively actuated for hinging the backrest relative to the framework.

11. The shower chair assembly of claim 10, wherein the actuator comprises a lever.

12. The shower chair assembly of claim 1, further including a plurality of apertures positioned in the seat and the backrest, wherein the apertures are configured for draining of water from the seat and the backrest.

13. The shower chair assembly of claim 1, further including a pair of rods engaged to the upper end of the framework and extending transversely to the front of the framework toward the lower end of the framework, the footrest being engaged to the pair of rods distal from the framework, each rod comprising a plurality of nested segments, such that the rod is selectively extensible for adjusting the footrest relative to the seat.

14. The shower chair assembly of claim 13, wherein the footrest is hingedly engaged to the pair of rods, wherein the footrest is configured for being selectively hinged between a deployed configuration and a stowed configuration.

15. The shower chair assembly of claim 13, further including:

the plurality of nested segments comprising a lower segment selectively extensible from an upper segment;

a pair of first fasteners, each first fastener being engaged to a respective upper segment; and a pair of second fasteners, each second fastener being engaged to a respective lower segment, the second fastener being complementary to the first fasteners, such that the second fastener is positioned for selectively engaging an associated first fastener for fixedly positioning the respective lower segment relative to an associated upper segment.

16. The shower chair assembly of claim 15, wherein:

the second fastener comprises a pin, the pin being spring-loaded; and the associated first fastener comprising a plurality of holes.

17. A shower chair assembly comprising:

a framework configured for selectively positioning in a shower enclosure, the framework comprising:

a frame, the frame being substantially rectangularly shaped, and a plurality of legs, each leg being engaged to and extending from a respective corner of the frame, each leg comprising a pair of nestable sections, such that the leg is selectively extensible;

a plurality of feet, each foot being engaged to a respective leg distal from the frame, the feet being resiliently compressible, such that the feet are configured for frictionally engaging a surface of the shower enclosure upon with the framework is positioned, the feet being cup-shaped, wherein the feet are configured for suctionally engaging the surface, the feet comprising rubber, silicone, or elastomer;

a seat engaged to an upper end of the framework, wherein the seat is configured for seating a user;

a backrest hingedly engaged to rear of the framework proximate to the upper end, such that the backrest is selectively reclinable, wherein the backrest is configured for supporting a back of the user, the backrest and the seat being molded, such that the backrest and the seat are convex, wherein the backrest and the seat are configured for complementing contours of buttocks and the back of the user, the backrest comprising:

a first section positioned proximate to the seat, the first section being substantially rectangularly shaped, wherein the first section is configured for supporting the back of the user, and a second section extending arcuately from and substantially coplanarly with the first section distal from the seat, wherein the second section is configured for supporting a head and a neck of the user;

a pair of bars hingedly engaged to the framework, the backrest being engaged to the pair of bars, each bar comprising a first segment and a second segment, the first segment being arcuate and proximate to the framework, the second segment extending linearly from the first segment;

an actuator engaged to the framework and being operationally engaged to the backrest, wherein the actuator is configured for being selectively actuated for hinging the backrest relative to the framework, the actuator comprising a lever;

a plurality of apertures positioned in the seat and the backrest, wherein the apertures are configured for draining of water from the seat and the backrest;

a single footrest engaged to and extending from a front of the framework and being selectively positionable between the upper end and a lower end of the framework, wherein the footrest is configured for supporting feet of the user, for facilitating completion of hygienic and beautification tasks on the feet, said footrest being centered relative to a pair of lateral sides of said framework and projecting forwardly relative to said seat wherein said footrest is configured for supporting both feet of the user simultaneously;

a pair of rods engaged to the upper end of the framework and extending transversely to the front of the framework toward the lower end of the framework, the footrest being engaged to the pair of rods distal from the framework, each rod comprising a plurality of nested segments, such that the rod is selectively extensible for adjusting the footrest relative to the seat, the plurality of nested segments comprising a lower segment selectively extensible from an upper segment, the footrest being hingedly engaged to the pair of rods, wherein the footrest is configured for being selectively hinged between a deployed configuration and a stowed configuration;

a pair of first fasteners, each first fastener being engaged to a respective upper segment;

a pair of second fasteners, each second fastener being engaged to a respective lower segment, the second fastener being complementary to the first fasteners, such that the second fastener is positioned for selectively engaging an associated first fastener for fixedly positioning the respective lower segment relative to an associated upper segment, the second fastener comprising a pin, the pin being spring-loaded, the associated first fastener comprising a plurality of holes; and a cover selectively engageable to the footrest for removably covering at least an upper face of the footrest, wherein the cover is configured for positioning of the feet of the user and for being removed for laundering.

* * * * *